United States Patent [19]

Haag

[11] 4,226,489

[45] Oct. 7, 1980

[54] DOOR SEAL ASSEMBLY

[75] Inventor: Charles W. Haag, Center Township, Vanderburgh County, Ind.

[73] Assignee: Whirlpool Corporation, Benton Harbor, Mich.

[21] Appl. No.: 38,574

[22] Filed: May 14, 1979

[51] Int. Cl.[3] ..... E06B 7/16; E05C 7/04; F25D 11/00

[52] U.S. Cl. ..... 312/296; 312/214; 49/366; 49/478; 49/483

[58] Field of Search ..... 312/296, 214; 49/366, 49/367, 368, 478, 487, 483

[56] References Cited

U.S. PATENT DOCUMENTS

| | | | |
|---|---|---|---|
| 2,811,406 | 10/1957 | Moore et al. | 312/296 |
| 3,070,852 | 1/1963 | Hilliker | 312/296 |
| 3,248,159 | 4/1966 | Hall | 312/296 |
| 3,259,446 | 7/1966 | Harle et al. | 312/296 |
| 3,264,048 | 8/1966 | Koch et al. | 312/296 |
| 3,359,053 | 12/1967 | Hagendoorn | 312/296 |
| 3,382,618 | 5/1968 | Townsend | 49/483 |
| 3,408,772 | 11/1968 | Frehse | 49/366 |
| 3,942,853 | 3/1976 | Grimm et al. | 312/296 |

*Primary Examiner*—Victor N. Sakran

*Attorney, Agent, or Firm*—Wegner, Stellman, McCord, Wiles & Wood

[57] ABSTRACT

A door assembly having first and second pivotally mounted doors defining juxtaposed portions in a closed arrangement thereof. A seal structure is provided for sealing the juxtaposed edges of the doors in the closed arrangement. The seal structure defines inner and outer seals cooperatively forming a large closed air space therebetween. The seals may include overlapping sealing portions which may have magnetized structures therein for effecting a positive seal. The seals may include relatively stiff or rigid mounting portions secured to rearwardly projecting dikes on the doors and effectively defining opposed projections of the dikes extending a substantial portion of the distance between the dikes. The seals may include flexible sealing portions at the distal ends of the rigid mounting portions.

19 Claims, 3 Drawing Figures

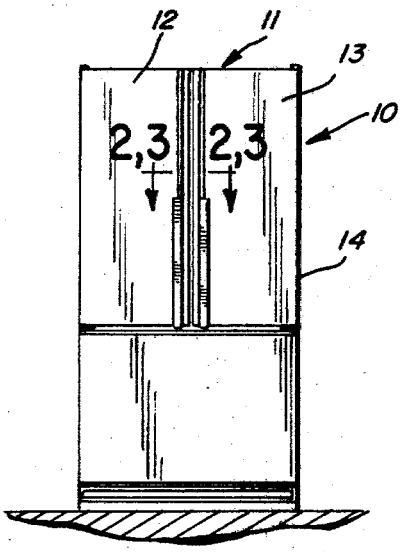
FIG. 1
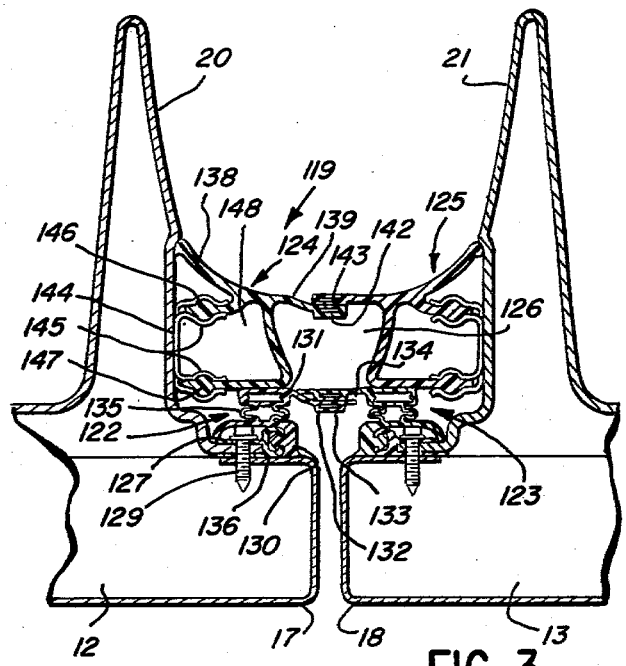
FIG. 3
FIG. 2
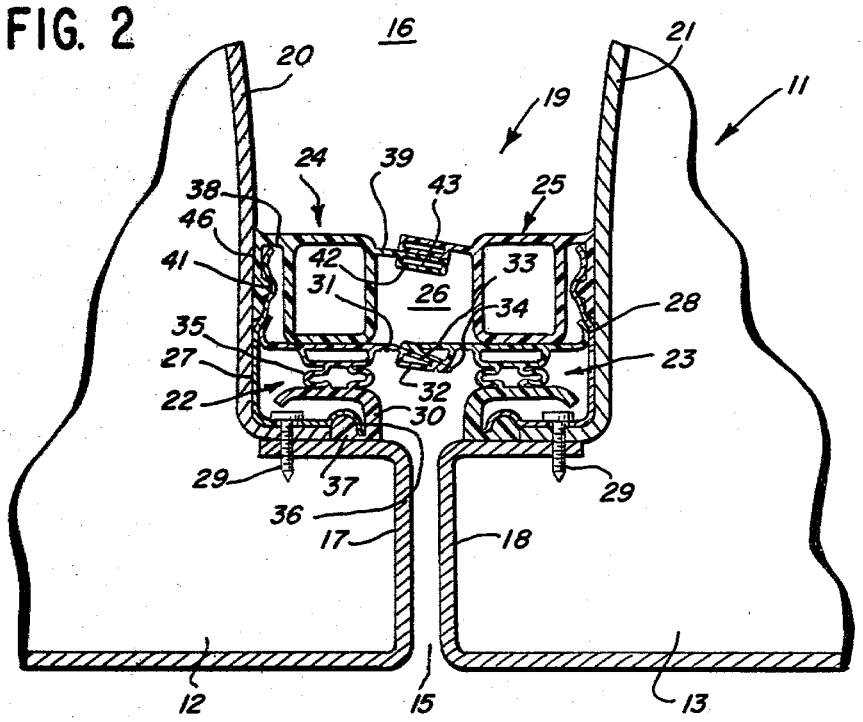

DOOR SEAL ASSEMBLY

BACKGROUND OF THE INVENTION

1. Field of the Invention

This invention relates to door assemblies and in particular to means for sealing French type door assemblies for refrigerators, wherein first and second pivotally mounted doors are arranged to define juxtaposed edge portions in a closed arrangement thereof.

2. Description of the Prior Art

A number of magnetic seals have been developed for use in sealing French door refrigerators. One example of such a seal is shown in U.S. Pat. No. 3,248,159 of Charles E. Hall. As shown therein, magnetized seal elements are brought into juxtaposition when the doors are closed so as to provide a seal between the slightly spaced door edges.

Alan J. Koch et al in U.S. Pat. No. 3,264,048, which patent is owned by the assignee hereof, shows a magnetic gasket for use in sealing the door of a refrigerated apparatus wherein overlapping magnetic seals are provided on the juxtaposed ends of a pair of gaskets.

In U.S. Pat. No. 3,382,618, Russell S. Townsend shows a closure seal for a refrigerator cabinet having French style, side-by-side doors. The seal includes a pair of flexible gaskets, each of which is U-shaped in cross sections and having its legs extending toward the legs of the other gasket. One pair of the legs overlaps in sealing relation with the other pair of legs so as to define a partial dead air space in the refrigerated space between the doors. The outermost legs do not overlap and are spaced from each other to define an air insulating cavity in the nature of a partial dead air cell when the doors are closed.

In U.S. Pat. No. 3,408,772 of Walter C. Frehse, a gasket for a multiple door cabinet is shown which utilizes magnetized seal portions in sealing oppositely swinging doors. The embodiment shown in FIGS. 8–11 includes a single set of overlapping magnetic gasket portions.

Bernard J. Grimm et al discloses in U.S. Pat. No. 3,942,853 a gasket assembly for a household refrigerator wherein side-by-side doors are sealed by magnetic sealing means. A pair of elongated flanges is connected to the insulating member defined by the gasket element so as to contact one another inwardly of the magnetic seals. The seals are secured to the rear surface of the door but do not contact a rearwardly projecting door dike, and each of the seals is defined by non-overlapping elements relying solely on the spaced portions thereof being brought into confronting abutment.

SUMMARY OF THE INVENTION

The present invention comprehends an improved door assembly having first and second pivotally mounted doors defining juxtaposed edge portions in a closed arrangement of the doors. A pair of dikes is carried one each on the doors to extend rearwardly from the edge portions thereof in spaced relationship to each other in the closed arrangement of the doors. An improved sealing structure is provided including an outer, first pair of seals carried one each by the door edge portions and extending therefrom into sealed engagement with each other in the closed arrangement of the doors. An inner, second pair of seals is carried one each by the doors and extending into sealed engagement with each other inwardly of the first pair of seals in the closed arrangement of the doors. The first and second pairs of seals define a large dead air space between the dikes providing an effective thermal and moisture barrier between the doors in the closed arrangement thereof.

The sealed dead air space may extend fully between the dikes intermediate the first and second pairs of seals.

In one form, the seals are secured to the doors by brackets. The dead air space may extend fully between the brackets and the inner and outer pairs of seals.

The seals may be removably secured to the doors or dikes by the mounting brackets which may include snap connecting portions.

The seals may include relatively rigid mounting portions mounted to the door, and relatively flexible sealing portions defining the distal portions of the seals which may be overlapped in the sealed arrangement.

The mounting portions may extend across a major portion of the space between the dikes so as to effectively define inward extensions of the dikes in supporting the flexible sealing portions of the seals. The mounting portions may, themselves, or cooperatively with the dikes, also define dead air spaces.

Thus the sealing means of the present invention provides a relatively large dead air space having a relatively low thermal coefficient between the closed doors so as to reduce the amount of heat leakage from the exterior ambient air. As a result of the reduced heat leakage, the amount of condensation experienced adjacent the door gasket when operating the refrigerator under very high temperature and humidity conditions has been reduced.

The sealing means further provides an effective moisture seal for use with such French type door assemblies.

The seals may be readily and economically formed by conventional manufacturing techniques such as extrusion, and may be readily installed and removed from the door assemblies.

The seals are arranged to provide the desired overlapping sealing engagement irrespective of which of the doors is closed first.

The door assembly sealing means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a front elevation of a refrigeration apparatus having a door assembly embodying the invention;

FIG. 2 is a fragmentary enlarged horizontal section taken substantially along the line 2—2 of FIG. 1 illustrating in greater detail the sealing means of the door assembly; and FIG. 3 is a fragmentary enlarged horizontal section similar to that of FIG. 2 but showing a modified form of sealing means embodying the invention.

DESCRIPTION OF THE PREFERRED EMBODIMENTS

In the exemplary embodiment of the invention as shown in FIGS. 1 and 2 of the drawings, a refrigeration apparatus generally designated 10 is shown to include a door assembly generally designated 11 of the side-by-side, or French type door, including a first door 12 and a second door 13 pivotally mounted to the cabinet 14 of apparatus 10 so as to close the front opening 15 of a refrigerated compartment 16 within cabinet 14. In the illustrated embodiment, refrigeration apparatus 10 comprises an arrangement wherein the refrigerated compartment 16 is provided in the upper portion of the cabinet 14 with a freezer compartment of the apparatus disposed in the lower portion of the cabinet. As will be obvious to those skilled in the art, the invention is applicable to a wide range of additional cabinet assemblies, the arrangement of FIG. 1 being exemplary only.

As indicated above, it is desirable to seal the juxtaposed edge portions 17 and 18 of the doors 12 and 13 when the doors are disposed in the closed arrangement of FIG. 1. The present invention comprehends an improved sealing structure generally designated 19 which provides an improved effective thermal and moisture seal between the door portions 17 and 18, as illustrated in FIG. 2. Sealing structure 19 extends between a pair of vertically extending dikes 20 and 21 projecting rearwardly from the edge portion 17 and 18 partially into chamber 16. Such dikes are conventionally formed as in integral part of an inner liner (not shown) for the doors.

The sealing structure 19 includes a first outer pair of seals 22 and 23, and a second inner pair of seals 24 and 25 spaced inwardly of outer seals 22 and 23 and defining therebetween a dead air space 26. A dead air space, such as space 26, is a zone in which the circulation of refrigerated air is substantially impeded. Such dead air spaces provide an effective barrier to heat transfer and can therefore be used to advantage in sealing the doors of refrigerated cabinets.

Sealing structure 19 further includes a pair of means, shown as brackets 27 and 28 which may be secured to the door edge portion 17 and 18 by suitable means such as screws 29.

As shown in FIG. 2, seals 22 and 23 can be identical in cross section. Each seal includes a relatively rigid or stiff mounting portion 30 and a relatively more flexible sealing portion 31. The sealing portion includes a distal end portion 32 provided with a magnet 33. Projecting outwardly from the portion 32 is a tab 34. The sealing portion may be connected to the mounting portion 30 by a flexible accordion portion 35 for facilitated movement of the sealing portion during the sealing operation.

Each of the mounting brackets is provided with an outer spring clip portion 36. The seal mounting portion 30 includes a retaining portion 37 adapted to be inserted under the clip portion 36 of the mounting bracket so as to be effectively positively retained in place on the door edge portion.

As further shown in FIG. 2, the inner seals 24 and 25 can also be identical in cross section. Each includes a rigid, or stiff, mounting portion 38 and a more flexible sealing portion 39. The mounting portion may include a turned flange 40 which may be removably retained by a spring clip portion 41 at the inner end of the mounting bracket.

The sealing portion may include a distal portion 42 containing a magnet 43.

FIG. 2 illustrates the arrangement of the door assembly where the right hand door 13 is placed in the closed position prior to the placement of the left hand door 12 in the closed position and, thus, the sealing portions 31 and 39 of the seals 22 and 24 are disposed outwardly of the sealing portions of seals 23 and 25 respectively. As will be obvious to those skilled in the art, a reverse arrangement occurs where the door 12 is moved to the closed position prior to the movement of the door 13 thereto.

Each of the seals may comprise an extrusion of conventional synthetic resin material, such as vinyl plastic. Each of the sections may be formed by conventional dual durometer techniques wherein the rigid portion of the seal is formed concurrently with the more flexible sealing portion. The seals effectively define two sets of overlapping flaps which provide an improved seal between the door edge portions. As seen in FIG. 2, the seal arrangement is such as to provide a relatively large dead air space 26 for improved thermal and moisture barrier characteristics of the sealing structure. This improved seal is particularly apparent when the refrigerator is operated under high ambient temperature and humidity conditions. As seen in FIG. 2, the dead air space 26 may extend substantially between the spaced dikes 20 and 21, and, specifically, may extend between the mounting brackets 27 and 28 and portions of the seals facially juxtaposed to the mounting brackets.

The rigid mounting portions 38 of the inner seals 24 and 25 effectively define extensions of the dikes 20 and 21, respectively, which extend across a major portion of the space between the dikes, permitting the sealing portions 39 to be disposed primarily at the center of the sealing space.

The use of the snap-fit connections between the seal mounting portions and the door permits facilitated installation and removal of the seals, as for servicing and maintenance.

Referring now to the embodiment of FIG. 3, a second embodiment of sealing structure generally designated 119 is shown to comprise a sealing structure generally similar to sealing structure 19. As shown, sealing structure 119 includes a pair of outer seals 122 and 123 and a pair of inner seals 124 and 125. As shown, seals 122 can be identical in cross section to seals 123, and seals 124 can be identical in cross section to seals 125.

Each of the outer seals includes a mounting portion 130 snap-fitted to a retaining portion 136 of a mounting bracket 127 which in turn is secured to the edge portion 17 by a suitable screw 129.

Each of the outer seals further defines a sealing portion 131 including a distal portion 132 provided with a magnet 133 and an outwardly extending tab 134. The sealing portion 131 may be connected to the mounting portion 130 by a flexible connecting portion 135. Thus, outer seals 122 and 123 are generally similar to the outer seals 22 and 23 of sealing structure 19.

The inner seals include a relatively rigid mounting portion 138 secured to the dike by a mounting bracket 144 having a pair of spring clip portions 145. The mounting portion 138 of the seal includes a pair of legs 146 and 147 snap-fitted to the spring clip portions 145 so as to be removably secured to the door dikes adjacent the door edge portions. Each of the inner seals further includes a flexible sealing portion 139 having a distal portion 142 provided with a magnet 143.

Thus, the outer seals 122 and 123 cooperate with the inner seals 124 and 125 to define a substantial dead air space 126 between the seals. Further, the leg portions 146 and 147 of the seal mounting portions define an additional dead air space 148 adjacent to respective dikes 20 and 21 so that the space between the dikes is effectively divided into three series-related dead air spaces.

Sealing structure 119 is similar to sealing structure 19 in providing an effective thermal and moisture barrier irrespective of which of the doors 12 or 13 is closed first.

The sealing structure 119 is similar to sealing structure 19 in permitting the manufacture of the structure by conventional, dual durometer extrusion techniques. The seals may be readily installed and removed by means of the snap-fitting spring clip mountings and, thus, sealing structure 119 provides an improved sealing closure of the apparatus doors in a manner generally similar to that of sealing structure 19.

As further shown in FIG. 3, the sealing structure 119 provides an abutment between the sealing portion 131 of the outer seals and the mounting portion 138 of the inner seals, specifically, with the leg portion 147 of the inner seal mounting portion. Thus, a further heat and moisture barrier is obtained within the sealing structure 119.

In each of the embodiments the tabs 34, 134 provided on the outer seals provide improved appearance and sealing at the top and bottom of the doors 12 and 13. The flaps extend suitably to engage the cabinet 14 at the top and bottom of the doors and cooperate with the flap portions enclosing the magnets to effect a closure between the seals and cabinet at these points.

Spring clips 36 may forcibly urge the seal portions 37 against the door edge portions so as to provide a moisture barrier between the seal and door edge portion.

As is conventional in the construction of refrigerator cabinets, suitable insulation material (not shown) such as synthetic foam insulation, is provided in the hollow areas defined by doors 12 and 13.

The foregoing disclosure of specific embodiments is illustrative of the broad inventive concepts comprehended by the invention.

Having described the invention, the embodiments of the invention in which an exclusive property or privilege is claimed are defined as follows:

1. In a door assembly having first and second pivotally mounted doors defining juxtaposed edge portions in a closed arrangement of the doors, a pair of dikes carried one each on said doors to extend rearwardly from said edge portions in spaced relationship to each other in said closed arrangement, the improvement comprising:

an outer, first pair of seals mounted one each to said doors and extending therefrom into sealed engagement with each other in said closed arrangement of the doors; and an inner, second pair of seals mounted one each on said dikes and extending therefrom into sealed engagement with each other inwardly of said first pair of seals in said closed arrangement of the doors, said first and second pairs of seals defining a sealed dead air space between said dikes providing an effective thermal and moisture barrier between said doors in said closed arrangement.

2. The door assembly of claim 1 wherein said sealed dead air space extends fully between said dikes intermediate said first and second pairs of seals.

3. The door assembly of claim 1 wherein said seals comprise flap seals.

4. The door assembly of claim 1 wherein said seals comprise mutually attracting magnetic seals.

5. The door assembly of claim 1 wherein said seals comprise distal portions disposed in overlapping relationship in said closed arrangement of the doors.

6. The door assembly of claim 1 wherein each seal of said first and second pairs of seals comprises a one piece, dual durometer extrusion.

7. The door assembly of claim 1 including a pair of mounting brackets carried one each by said dikes for removably securing said second seals to said dikes.

8. The door assembly of claim 1 wherein said seals include a first stiff mounting portion secured to the doors, and second, distal sealing portion which is flexible for providing said sealed engagement between the seals in said closed arrangement of the doors.

9. In a refrigeration apparatus defining a refrigerated chamber and having a door assembly having first and second pivotally mounted doors defining vertically extending juxtaposed edge portions in a closed arrangement of the doors across the chamber, a pair of vertically extending dikes carried one each on said doors to extend rearwardly from said edge portions in spaced relationship to each other in said closed arrangement, the improvement comprising:

a pair of mounting means;

an outer, first pair of seals having a relatively rigid mounting portion mounted one each by said mounting means to said doors and a flexible sealing portion extending therefrom into overlapped sealed engagement with each other in said close arrangement of the doors;

an inner, second pair of seals having a relatively rigid mounting portion mounted one each by said mounting means to said dikes and a flexible sealing portion extending therefrom into sealed engagement with each other inwardly of said first pair of seals in said closed arrangement of the doors, said first and second pairs of seals defining a substantial dead air space within said refrigerated chamber adjacent said doors, thereby providing an effective thermal and moisture barrier when said doors are in said closed arrangement.

10. The refrigeration apparatus door assembly of claim 9 wherein said mounting means define snap connectors removably securing said mounting portions of at least one of said pairs of seals to said doors.

11. The refrigeration apparatus door assembly of claim 9 wherein said mounting means define snap connectors removably securing said mounting portions of said first pair of seals to said doors.

12. The refrigeration apparatus door assembly of claim 9 wherein said rigid mounting portions of at least one of said pairs of seals extend across a major portion of the space between said dikes.

13. The refrigeration apparatus door assembly of claim 9 wherein said rigid mounting portions for said second pair of seals define a lateral extension of said dikes.

14. The refrigeration apparatus door assembly of claim 9 wherein the sealing portions of said first pair of seals are provided with laterally projecting distal tabs.

15. The refrigeration apparatus door assembly of claim 9 wherein said sealed dead air space extends substantially fully between said dikes intermediate said first and second pairs of seals.

16. The refrigeration apparatus door assembly of claim 9 wherein said rigid portion of said second pair of seals itself defines a dead air space.

17. The refrigeration apparatus door assembly of claim 9 wherein the lateral extent of said dead air space is substantially greater than the space between said juxtaposed door edge portions.

18. In a refrigeration apparatus defining a refrigerated chamber and having a door assembly having first and second pivotally mounted doors defining juxtaposed edge portions when said doors close said chamber, a pair of rearwardly extending members carried one each on the inner surface of said doors and extending vertically therealong and being laterally spaced from each other by a distance greater than the space between said juxtaposed edge portions, the improvement comprising:

an outer, first pair of seals carried one each by said doors and extending laterally between said rearwardly extending members into sealed engagement with each other when said doors are positioned to close said chamber; and, an inner, second pair of seals carried one each by said doors and extending laterally between said rearwardly extending members into sealed engagement with each other when said doors are positioned to close said chamber, said first and second pairs of seals defining a dead air space extending substantially completely between said rearwardly extending members.

19. The refrigeration apparatus door assembly of claim 18 wherein said second pair of seals is affixed one each to said rearwardly extending members.

* * * * *